US007337562B2

(12) United States Patent
Kim

(10) Patent No.: US 7,337,562 B2
(45) Date of Patent: Mar. 4, 2008

(54) INNER SOLE ADJUSTABLE IN WEIGHT

(75) Inventor: Hee-Suk Kim, #402 Baekyang Villa, 11-3 Sambang-dong, Kimhae, Kyungsangnam-do 621-908 (KR)

(73) Assignees: Hee-Suk Kim, Kyungsangnam-Do (KR); Aison Co., Ltd., Pusan (KR)

( * ) Notice: Subject to any disclaimer, the term of this patent is extended or adjusted under 35 U.S.C. 154(b) by 344 days.

(21) Appl. No.: 10/523,189

(22) PCT Filed: Aug. 7, 2003

(86) PCT No.: PCT/KR03/01577

§ 371 (c)(1),
(2), (4) Date: Aug. 19, 2005

(87) PCT Pub. No.: WO2004/014172

PCT Pub. Date: Feb. 19, 2004

(65) Prior Publication Data

US 2006/0010720 A1 Jan. 19, 2006

(30) Foreign Application Priority Data

Aug. 7, 2002 (KR) ..... 20-2002-0023618 U

(51) Int. Cl.
*A43B 5/00* (2006.01)
*A43B 13/38* (2006.01)

(52) U.S. Cl. ..... 36/132; 482/79; 36/43; 36/3 B

(58) Field of Classification Search ..... 36/132, 36/43, 44, 3 B, 28, 29; 482/79
See application file for complete search history.

(56) References Cited

U.S. PATENT DOCUMENTS

| | | | | |
|---|---|---|---|---|
| 3,785,646 | A * | 1/1974 | Ruskin | 482/105 |
| 4,430,810 | A * | 2/1984 | Bente | 36/32 R |
| 6,397,498 | B1 * | 6/2002 | Yoo | 36/132 |
| 6,502,331 | B2 * | 1/2003 | Hines | 36/132 |
| 6,742,288 | B2 * | 6/2004 | Choi | 36/132 |
| 6,807,753 | B2 * | 10/2004 | Steszyn et al. | 36/28 |

FOREIGN PATENT DOCUMENTS

| | | | |
|---|---|---|---|
| JP | 2000-270903 | A | 10/2000 |
| KR | 20-0285242 | Y1 | 7/2002 |
| KR | 2002-0057917 | A | 7/2002 |

* cited by examiner

*Primary Examiner*—Ted Kavanaugh
(74) *Attorney, Agent, or Firm*—Workman Nydegger

(57) ABSTRACT

A footwear insole that is put into a footwear when used includes an insole body put in the footwear, and a load-applying part installed on a rear portion of the insole body to apply load to a user wearing the footwear with the insole body. When the user uses the footwear insole of the present invention, since the weight of the footwear is increased, the user can obtain an effect similar to a case that he/she wears a sandbag or a lead jacket, thereby increasing the burning of calories and exercise effect.

18 Claims, 9 Drawing Sheets

INNER SOLE ADJUSTABLE IN WEIGHT

TECHNICAL FIELD

The present invention relates to a footwear insole designed to be put in footwear, and more particularly, to a footwear insole, which is provided at a rear portion with a load-applying part to thereby increase the weight of the footwear.

BACKGROUND ART

As is well known, a sandbag or a lead-bag is often worn on an ankle of a user, or even a lead jacket is worn by a user as a load-applying member to enhance an exercise effect. Such a load-applying member increases the load applied to the user wearing the same, thereby increasing the burning of calories and improving the exercise effect. Therefore, the load-applying member has been used by athletes to quickly increase the exercise effect in a short period of time.

However, the user has to specially buy the load-applying member and needs a specific place and time for using the same. Although it is possible for the user to wear the load-applying member on his/her body in their daily lives, this may be unbecoming for a person who is not an athlete but wants to obtain the improved exercise effect during normal living.

Therefore, there is a need for load-applying means that is inconspicuous while increasing the load applied to the user to improve the exercise effect during a normal walk.

DISCLOSURE OF THE INVENTION

Accordingly, the present invention has been made in an effort to solve the above-described problems of the prior art.

An object of the invention is to provide a footwear insole that is provided at a rear portion with a load-applying part to thereby increase the weight of the footwear.

Another object of the present invention is to provide a footwear insole that is inconspicuous while increasing the load applied to the user to improve the exercise effect during normal walking.

To achieve these objects and other advantages and in accordance with the purpose of the invention, as embodied and broadly described herein, there is provided a footwear insole put in a footwear when used, comprising: an insole body put in the footwear; and a load-applying part installed on a rear portion of the insole body to apply load to a user wearing the footwear with the insole body.

The load-applying part comprises an insert member formed of a heavy weight material and installed in the insole body in parallel with a bottom of the insole body; and a receiving part for receiving the insert member, the receiving part being formed of an elastic material.

The load-applying part is designed to be attachable to or detachable from the insole body.

BEST MODE FOR CARRYING OUT THE INVENTION

It is to be understood that the following detailed description with the accompanying drawings of the present invention are exemplary and explanatory, and therefore it will be apparent to those skilled in the art that various modifications and variations can be made in the present invention.

Figure 1:
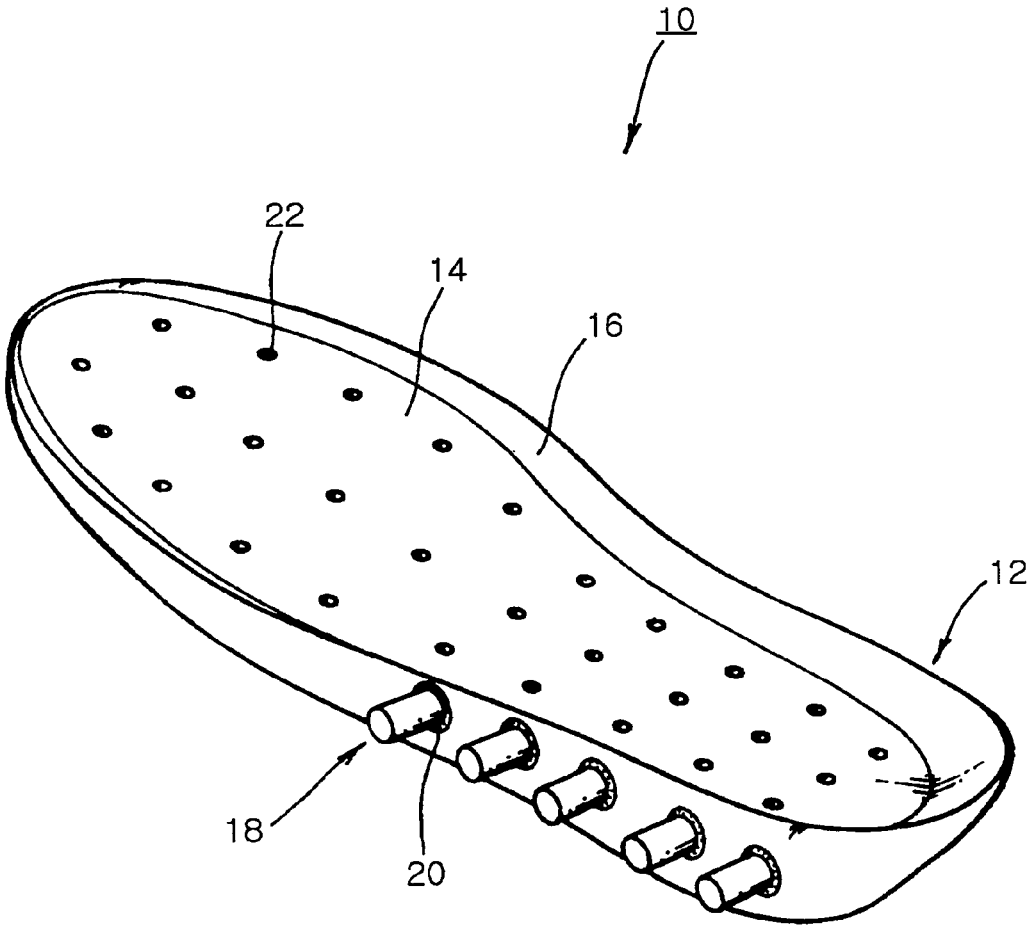
FIG. 1 is a perspective view of a footwear insole according to a first embodiment of the present invention, in which metal rods are partly inserted into the footwear insole.
Figure 2:
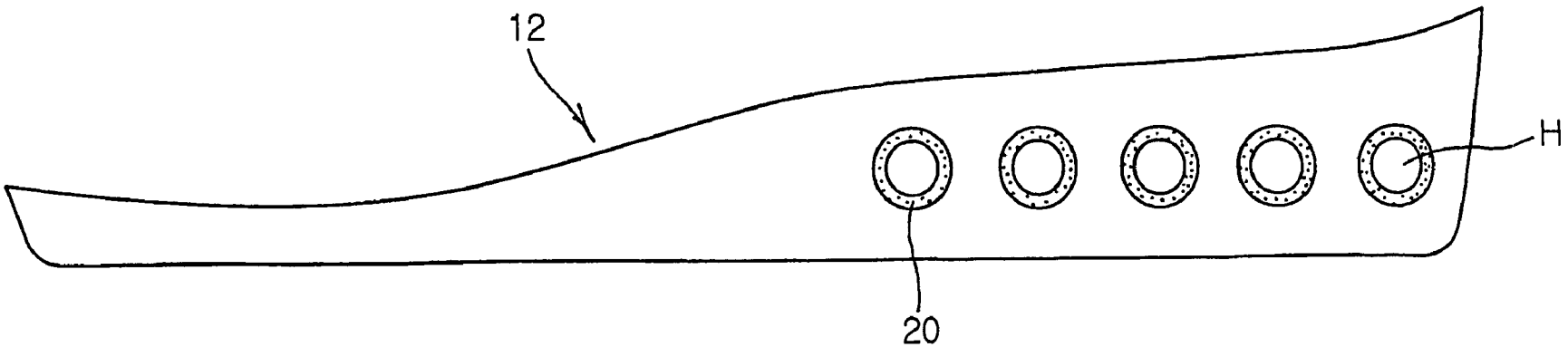
FIG. 2 is a side view of a footwear insole according to a first embodiment of the present invention, in which metal rods are removed from the footwear insole.

FIG. 1 shows a perspective view of a footwear insole according to a first embodiment of the present invention, in which metal rods are partly inserted into the footwear insole, and FIG. 2 shows a side view of a footwear insole according to a first embodiment of the present invention, in which metal rods are removed from the footwear insole.

As shown in the drawings, the inventive footwear insole 10 has an insole body 12 that is substantially identical to the conventional one in its general shape. That is, the footwear insole 10 has an insole base 14 whose thickness gradually increases as it goes from a front end to a rear end, and a protruded edge 16 that is elevated from an edge of the insole base 14. The insole body 12 is formed of a material that has elasticity and flexibility that are required for the footwear insole.

The insole body 12 is provided at a rear portion where the heel of a user will be located with holes H in which cylindrical metal rods 18 can be inserted. FIG. 1 shows a state that half of each rod 18 is inserted into each hole H, and FIG. 2 shows a state that the rods 18 are taken out of the holes H. To realize this structure, a rear portion of the footwear insole 10 of the present invention may have a thickness greater than that of the conventional one.

Meanwhile, a cylindrical receiving part 20 for removably receiving the metal rods 18 is formed around each of the holes 18. The cylindrical receiving part 20 has a length identical to or slightly greater than that of the metal rod 18. Although the receiving part 20 is partly shown in FIGS. 1 and 2 for the convenience, it is preferable that the receiving part 20 is installed penetrating the insole body 12 in a lateral direction. Since the receiving part 20 is formed penetrating the insole body 12 in the lateral direction and the metal rod 18 has a length substantially identical to that of the receiving part 20, it is easy to insert or remove the metal rod 18 into or from the receiving part 20. That is, the metal rod 18 can be fully inserted into the receiving part 20 by a simple pushing operation, and can be removed from the receiving part 20 by pushing one end of the metal rod so that it can be partly exposed out of the receiving part 20 as shown in FIG. 1 and pulling the exposed portion of the metal rod 18 to fully remove the metal rod from the receiving part 20.

The receiving part 20 is formed of an elastic material that can absorb impact applied to the metal rod 18, thereby providing a smooth feeling to a user wearing footwear comprising the footwear insole 10 with the metal rods 18. The elastic material absorbs the impact caused by the user's weight while preventing the deformation of the receiving part 20 when the metal rod 18 is removed. The elastic material can be formed of a synthetic resin-based material, a rubber-based material, a metal-based material, or a mixture material thereof. The synthetic resin-based material is selected from the group including polycarbonate (PC), polyurethane (PU), polyvinyl chloride (PVC), polyethylene (PE), acrylonitrile butadiene styrene (ABS), nylon, TPR, acryl, and PETE. The rubber-based material is selected from the group including natural rubber and synthetic rubber. The metal-based material is selected from the group including a shape memory alloy, titanium, spring steel, brass, aluminum, and an alloy thereof.

Figure 3:
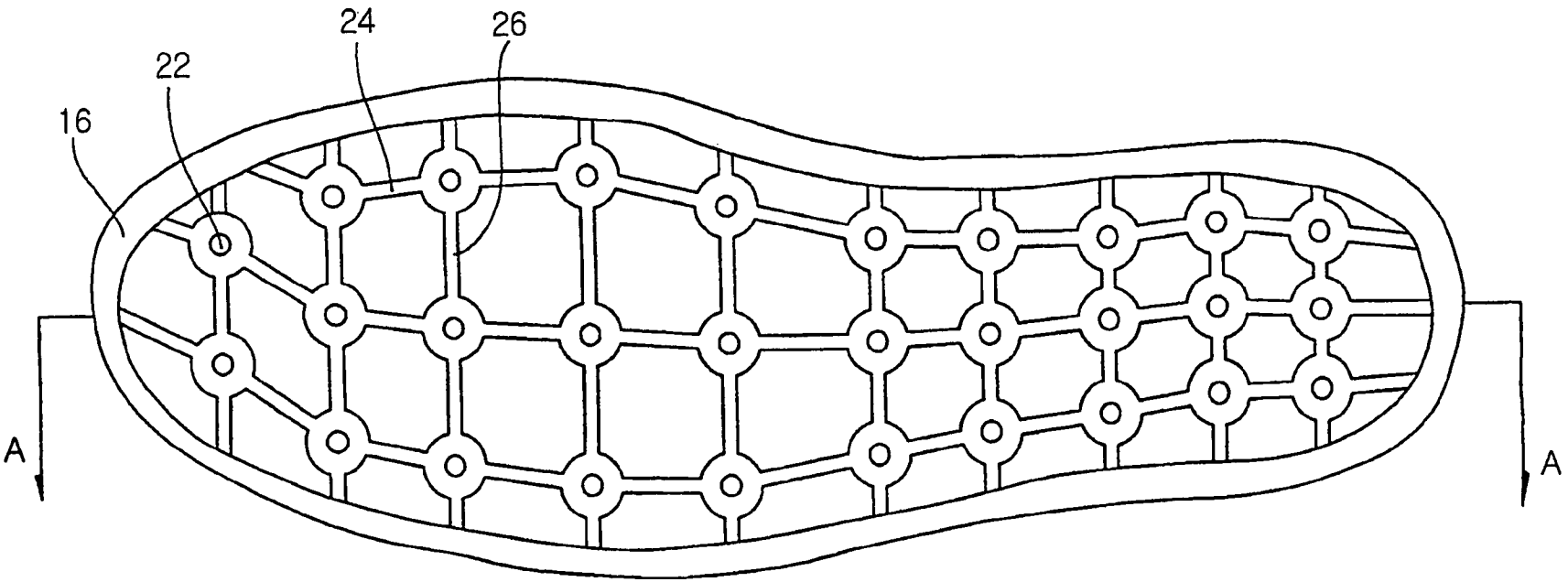
FIG. 3 is a bottom view of a footwear insole according to the present invention.
Figure 4:
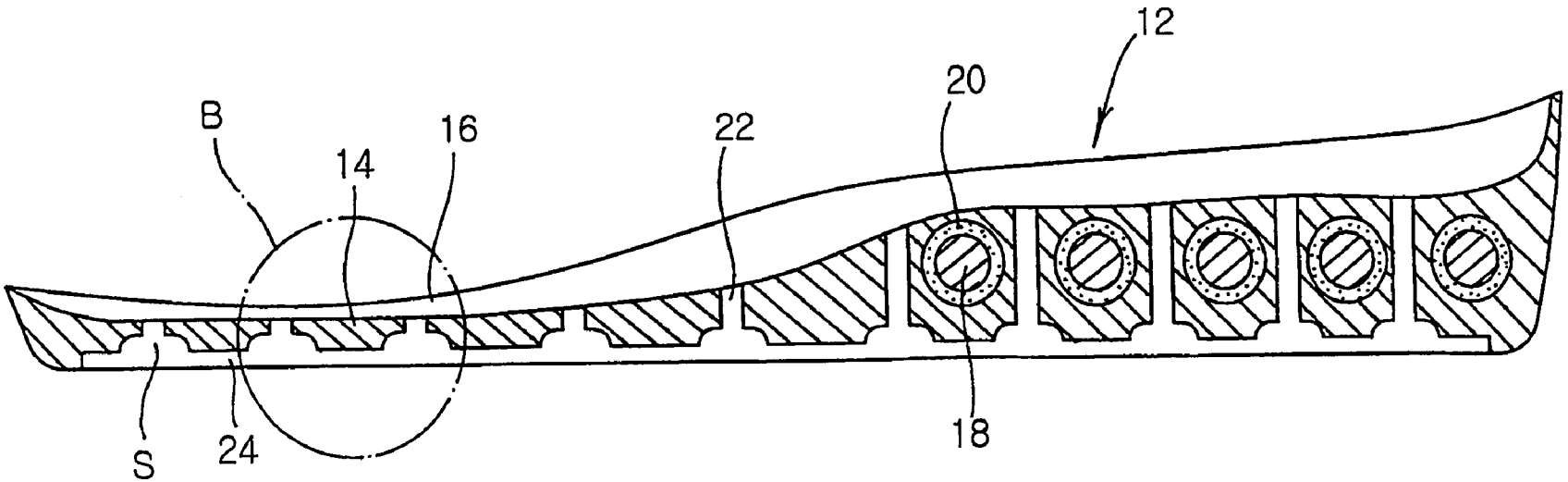
FIG. 4 is a sectional view taken along line A-A in FIG. 3.
Figure 5:
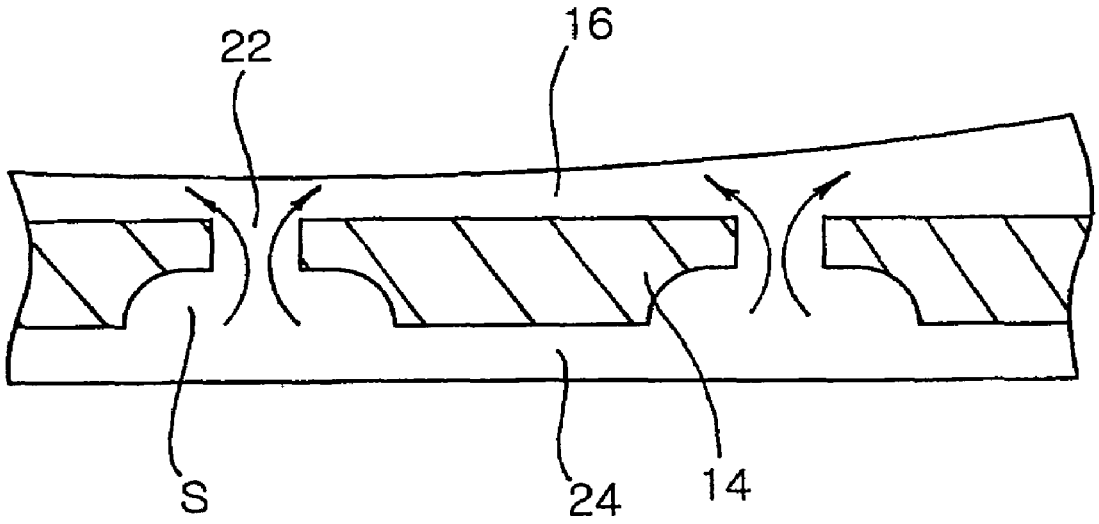
FIG. 5 is an enlarged view of a circled portion B of FIG. 4 to illustrate an air circulation device.

FIG. 3 shows a bottom view of a footwear insole according to the present invention, FIG. 4 shows a sectional view taken along line A-A in FIG. 3, and FIG. 5 shows an enlarged view of a circled portion B of FIG. 4 to illustrate an air circulation device.

As shown in the drawings, the insole base 14 is provided at a bottom with three longitudinal grooves 24 formed in a longitudinal direction of the footwear insole 10, and a plurality of lateral grooves 26 formed in a lateral direction of the footwear insole 10 to cross the longitudinal grooves 24. A plurality of vertical passages 22 are formed to penetrate the footwear insole 10 in a vertical direction at crossing points of the longitudinal and lateral grooves 24 and 26. An empty space S is formed at each of the crossing points where the passage 22 is formed.

When the user wears the footwear with the footwear insole and walks, the insole base 14 is compressed when the footwear contacts the ground and the volume of the empty spaces S is reduced. At this point, the air in the empty spaces S is directed to the foot of the user through the passages 22. When the user's footwear comes off the ground, the empty spaces S are intended to return to their initial shape by elastic force of the insole base 14. The returning force sucks the air into the empty spaces S through the vertical passages 22 and the grooves 24 and 26.

The above process is repeated while the user works or runs, so the footwear enclosing the user's foot is well ventilated, thereby providing a cool feeling to the user. That is, the ventilation allows the user's foot to maintain a dried state to provide good sanitation.

Figure 6:
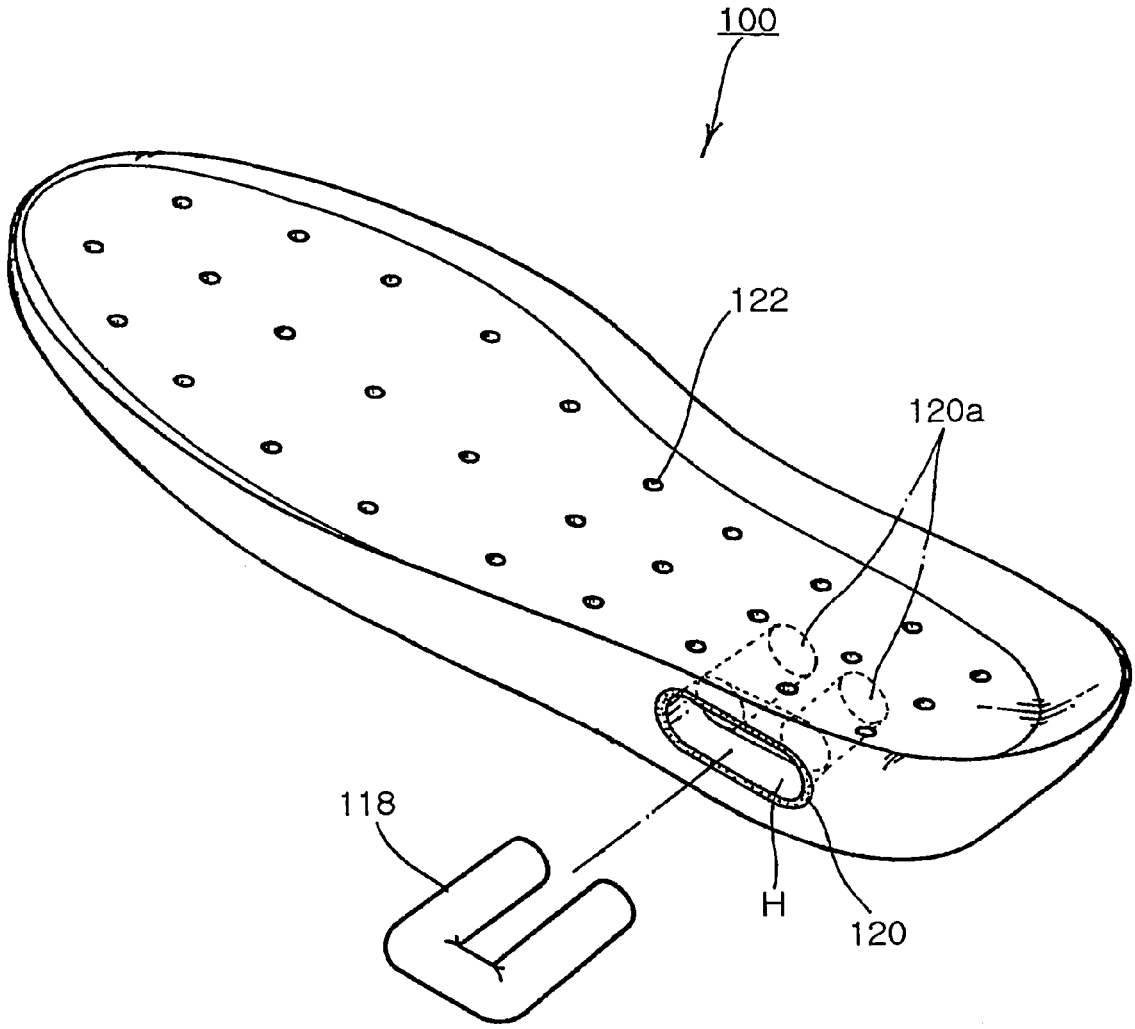
FIG. 6 is a perspective view of a footwear insole according to a second embodiment of the present invention, in which a U-shaped metal rod is removed from the footwear insole.

FIG. 6 shows a perspective view of a footwear insole according to a second embodiment of the present invention. Since a footwear insole 100 of this second embodiment is similar to the footwear insole 10 of the first embodiment, only the different parts will be described herein.

The footwear insole 100 of this embodiment employs a U-shaped metal rod 118 while that of the first embodiment employs a plurality of cylindrical metal rods 18. Therefore, the receiving part 120 is designed to receive the U-shaped metal rod 118. The member 120 has two parallel receiving passages 120*a* and it is preferable that vertical passages 122 for ventilation are not communicated with the two parallel receiving passages 120*a*.

Figure 7:
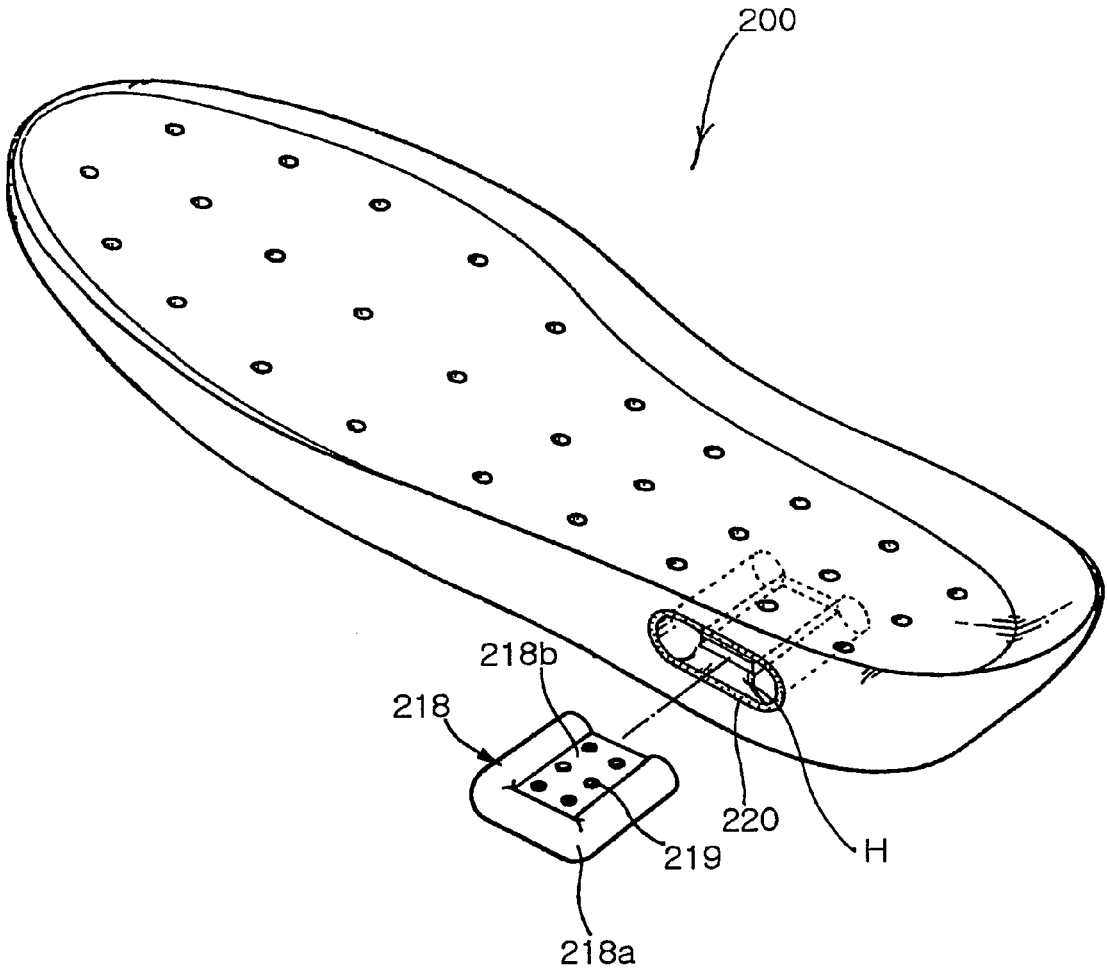
FIG. 7 is a perspective view of a footwear insole according to a third embodiment of the present invention, in which a metal plate is removed from the footwear insole.

FIG. 7 shows a perspective view of a footwear insole according to a third embodiment of the present invention. Since a footwear insole 200 of this third embodiment is similar to the footwear insole 10 of the first embodiment, only the different parts will be described herein.

The footwear insole 200 of this embodiment employs a metal plate 218 while that of the first embodiment employs a plurality of cylindrical metal rods 18. Therefore, the receiving part 220 is designed to receive the metal plate 118. The metal plate 218 includes a U-shaped rod portion 218*a* and a flat portion 218*b* integrally formed with the inner surface of the U-shaped rod portion 218*a*. The flat portion 218*b* is provided with a plurality of holes 219 communicating with the vertical passages 222 for the ventilation.

The shape of the metal plate 218 is not limited to the above. That is, metal plate can be designed to be flat throughout its whole surface.

Figure 8:
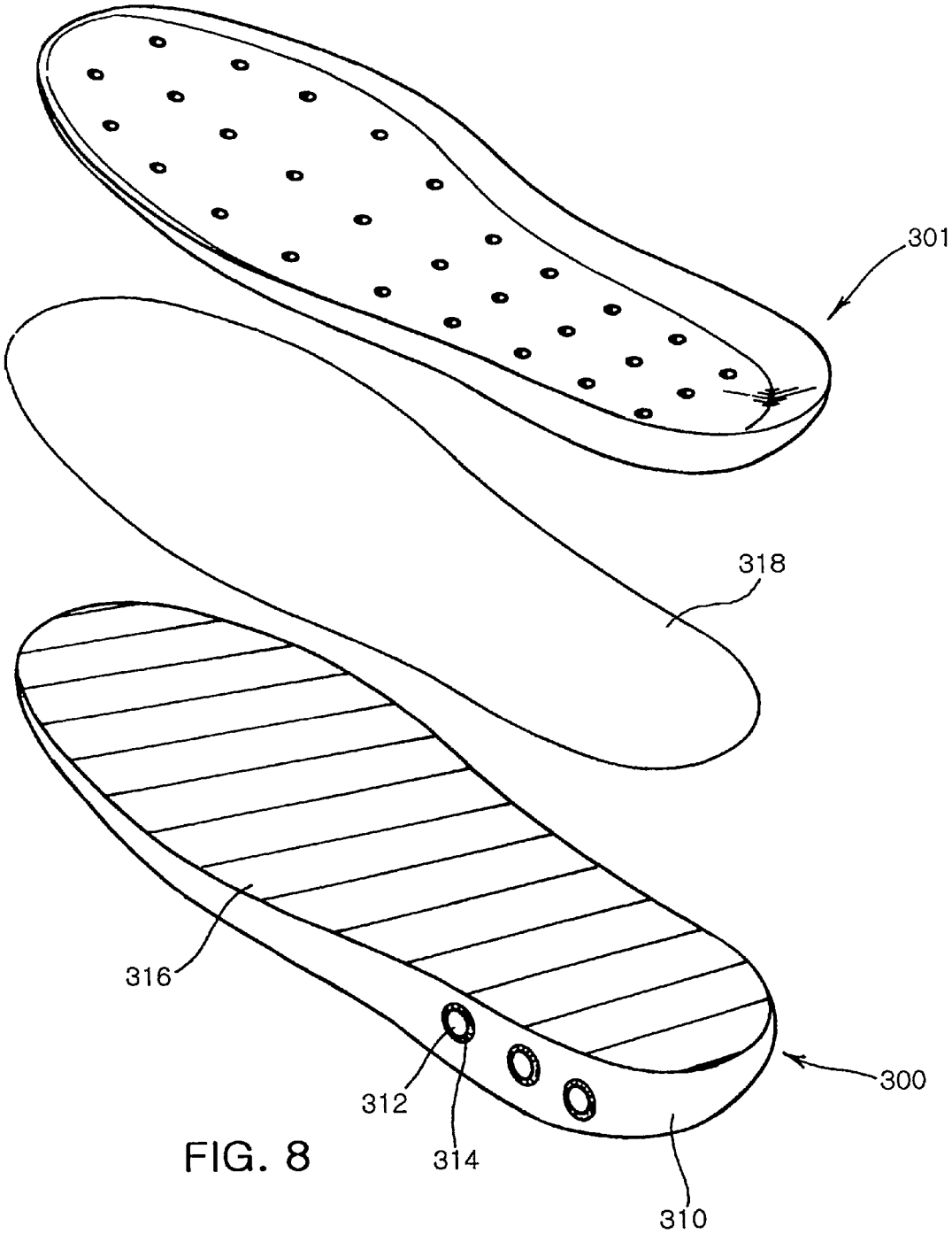
FIG. 8 is a perspective view of a footwear insole according to a fourth embodiment of the present invention, in which a load-applying part is removed from the footwear insole.

FIG. 8 is a perspective view of a footwear insole according to a fourth embodiment of the present invention, in which a load-applying part 300 is separated from a conventional footwear insole.

That is, the load-applying part 300 of this embodiment is specially manufactured from the conventional footwear insole 301 and is designed to be attached on the conventional footwear insole 301. That is, the load-applying part 300 comprises a main body 310, metal rods 312 removably inserted into a rear portion of the main body 310, and receiving portions 314 for receiving the metal rods 314. Deposited on a top surface of the main body 310 is adhesive on which a protecting film 318 is attached to protect the adhesive from impurities. Accordingly, user can remove the protecting film 318 from the main body 310 and attach the load applying part 300 to a conventional footwear insole 310. Needless to say, it is also possible to fixedly attach the load-applying part on the footwear insole through adhesion or needlework process during a footwear manufacturing process. It is also possible for the user to use the load-applying part by putting the same in the footwear without using an adhesive whenever he/she wants to use the same.

In this embodiment, although three metal rods are exemplified for the descriptive convenience, the number of the metal rods is not limited in this embodiment. For example, as in the first, second and third embodiments, five metal rods, the U-shape metal rod or the metal plate can be used.

Meanwhile, in the above embodiments, although the metal rods 18, the U-shaped metal rod 118, the metal plate 218 and the metal rods 312 are all described to be removable from the footwear insole, they may be inserted into holes of the load applying part or the receiving part and then integrally formed with the footwear insole or the load-applying part through a molding process during the manufacturing process of the footwear insole.

In addition, the weigh increasing member is not limited to the metal rods 18, the U-shaped metal rod 118, the metal plate 218 and the metal rods 312 that are described in the above embodiments. A variety of modifications equivalent to them will be also possible. In addition, the metal can be replaced with a material or a mixture selected from stone, brick, and concrete.

Figure 9:
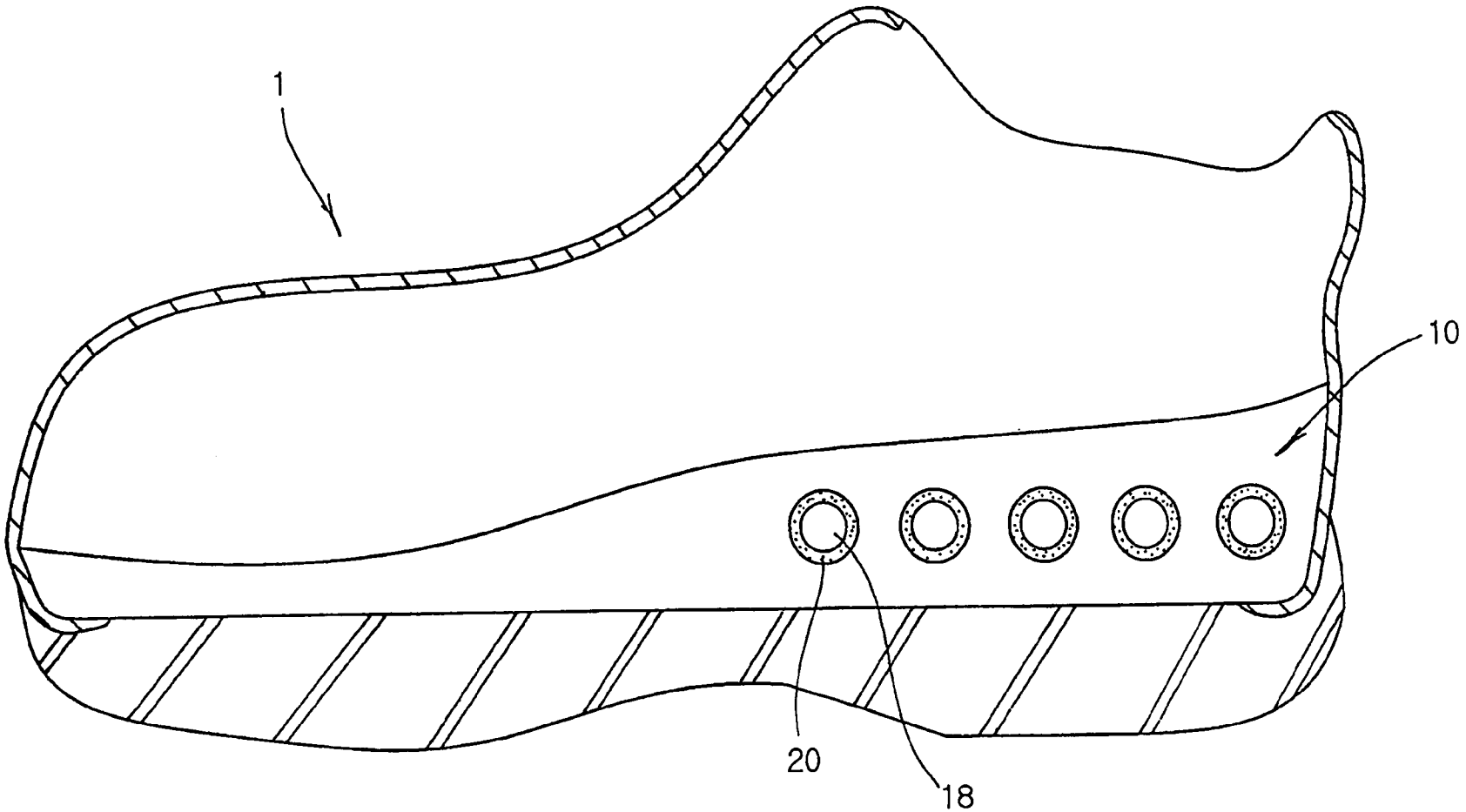
FIG. 9 is a sectional view of footwear where a footwear insole according to the first embodiment of the present invention is applied.

FIG. 9 shows a sectional view of footwear where a footwear insole according to the first embodiment of the present invention is applied.

The user uses the footwear insole 10 of the first embodiment in a state where it is put in the footwear as shown in FIG. 9. At this point, the metal rods 18 may be inserted into the footwear insole as shown in the drawing and removed from the footwear insole in case of need. When the metal rods 18 are inserted, since the weight of the footwear 1 is increased, the user can obtain an effect similar to a case that he/she wears the sandbag around his/her ankle. Furthermore, as described above, the air is discharged from the footwear insole 10 to refresh and dry the user's foot, maintaining the good sanitary of the footwear 1.

INDUSTRIAL APPLICABILITY

As described above, when the user uses the footwear insole of the present invention, since the weight of the footwear is increased, the user can obtain an effect similar to a case that he/she wears the sandbag or the lead jacket, thereby increasing the burning of calories and exercise effect.

In addition, wherever the user walks, the air is discharged from the footwear insole to reduce the temperature and moisture of the footwear, thereby refreshing and drying the user's foot and maintaining the good sanitary of the footwear.

Furthermore, since the height of the footwear insole of the present invention is greater than that of the conventional one, when the user wears the footwear having the footwear insole of the present invention, he/she looks taller.

In addition, when the metal rods are removed from the footwear insole, since the hard inserts are removed while maintaining the thickness of the insole, an effect that a cushion of the footwear is improved can be obtained.

The invention claimed is:

1. A footwear liner put in a footwear when used, comprising:

a liner body detachably inserted into the footwear; and a load-applying part installed on a rear portion of the liner body to apply load to a user wearing the footwear with the liner body, wherein the load-applying part comprises an insert member formed of a heavy weight material and installed in the liner body in parallel with a bottom of the liner body; and a receiving part for detachably receiving the insert member, the receiving part being formed of an elastic material for absorbing impact applied to the insert member to give smooth feeling to the foot of the user.

2. The footwear liner of claim 1, wherein the heavy weight material is one or a combination selected from the group consisting of metal, stone, a brick, and concrete.

3. The footwear liner of claim 2, farther comprising air circulation means for discharging air above a top surface of the liner body, the air circulation means comprising:

at least one longitudinal air passage defined by a groove formed on a lower bottom of the liner body in a longitudinal direction;

at least one lateral air passage defined by a groove formed on the lower bottom of the liner body in a lateral direction, the lateral air passage crossing the longitudinal air passage;

at least one vertical air passage formed vertically penetrating a crossing portion of the lateral and longitudinal air passages; and an empty space formed around the vertical air passage at the crossing portion.

4. The footwear liner of claim 1, wherein the insert member comprises at least one cylindrical rod.

5. The footwear liner of claim 4, further comprising air circulation means for discharging air above a top surface of the liner body, the air circulation means comprising:

at least one longitudinal air passage defined by a groove formed on a lower bottom of the liner body in a longitudinal direction;

at least one lateral air passage defined by a groove formed on the lower bottom of the liner body in a lateral direction, the lateral air passage crossing the longitudinal air passage;

at least one vertical air passage formed vertically penetrating a crossing portion of the lateral and longitudinal air passages; and an empty space formed around the vertical air passage at the crossing portion.

6. The footwear liner of claim 1, wherein the insert member comprises at least one U-shaped rod.

7. The footwear liner of claim 6, further comprising air circulation means for discharging air above a top surface of the liner body, the air circulation means comprising:

at least one longitudinal air passage defined by a groove formed on a lower bottom of the liner body in a longitudinal direction;

at least one lateral air passage defined by a groove formed on the lower bottom of the liner body in a lateral direction, the lateral air passage crossing the longitudinal air passage;

at least one vertical air passage formed vertically penetrating a crossing portion of the lateral and longitudinal air passages; and an empty space formed around the vertical air passage at the crossing portion.

8. The footwear liner of claim 1, wherein the insert member comprises at least one plate member.

9. The footwear liner of claim 8, further comprising air circulation means for discharging air above a top surface of the liner body, the air circulation means comprising:

at least one longitudinal air passage defined by a groove formed on a lower bottom of the liner body in a longitudinal direction;

at least one lateral air passage defined by a groove formed on the lower bottom of the liner body in a lateral direction, the lateral air passage crossing the longitudinal air passage;

at least one vertical air passage formed vertically penetrating a crossing portion of the lateral and longitudinal air passages; and an empty space formed around the vertical air passage at the crossing portion.

10. The footwear liner of claim 8, wherein the plate member has an edge thicker than a central portion.

11. The footwear liner of claim 10, further comprising air circulation means for discharging air above a top surface of the liner body, the air circulation means comprising:

at least one longitudinal air passage defined by a groove formed on a lower bottom of the liner body in a longitudinal direction;

at least one lateral air passage defined by a groove formed on the lower bottom of the liner body in a lateral direction, the lateral air passage crossing the longitudinal air passage;

at least one vertical air passage formed vertically penetrating a crossing portion of the lateral and longitudinal air passages; and an empty space formed around the vertical air passage at the crossing portion.

12. The footwear liner of claim 1, wherein the load-applying part is designed to be attachable to or detachable from the liner body.

13. The footwear liner of claim 12, further comprising air circulation means for discharging air above a top surface of the liner body, the air circulation means comprising:

at least one longitudinal air passage defined by a groove formed on a lower bottom of the liner body in a longitudinal direction;

at least one lateral air passage defined by a groove formed on the lower bottom of the liner body in a lateral direction, the lateral air passage crossing the longitudinal air passage;

at least one vertical air passage formed vertically penetrating a crossing portion of the lateral and longitudinal air passages; and an empty space formed around the vertical air passage at the crossing portion.

14. The footwear liner of claim 1, wherein the load-applying part is integrally formed with the liner body.

15. The footwear liner of claim 14, further comprising air circulation means for discharging air above a top surface of the liner body, the air circulation means comprising:

at least one longitudinal air passage defined by a groove formed on a lower bottom of the liner body in a longitudinal direction;

at least one lateral air passage defined by a groove formed on the lower bottom of the liner body in a lateral direction, the lateral air passage crossing the longitudinal air passage;

at least one vertical air passage formed vertically penetrating a crossing portion of the lateral and longitudinal air passages; and an empty space formed around the vertical air passage at the crossing portion.

16. The footwear liner of claim 1, wherein the elastic material can be formed of a synthetic resin-based material, a rubber-based material, a metal-based material, or a mixture material thereof, the synthetic resin-based material being selected from the group consisting of polycarbonate (PC), polyurethane (PU), polyvinyl chloride (PVC), polyethylene (PE), acrylonitrile butadiene styrene (ABS), nylon, TPR, acryl, and PETE, the rubber-based material being selected from the group consisting of natural rubber and synthetic rubber, and the metal-based material being selected from the group consisting of a shape memory alloy, titanium, spring steel, brass, aluminum, and an alloy thereof.

17. The footwear liner of claim 16, further comprising air circulation means for discharging air above a top surface of the liner body, the air circulation means comprising:

at least one longitudinal air passage defined by a groove formed on a lower bottom of the liner body in a longitudinal direction;

at least one lateral air passage defined by a groove formed on the lower bottom of the liner body in a lateral direction, the lateral air passage crossing the longitudinal air passage;

at least one vertical air passage formed vertically penetrating a crossing portion of the lateral and longitudinal air passages; and an empty space formed around the vertical air passage at the crossing portion.

18. The footwear liner of claim 1, frther comprising air circulation means for discharging air above a top surface of the liner body, the air circulation means comprising:

at least one longitudinal air passage defined by a groove formed on a lower bottom of the liner body in a longitudinal direction;

at least one lateral air passage defined by a groove formed on the lower bottom of the liner body in a lateral direction, the lateral air passage crossing the longitudinal air passage;

at least one vertical air passage formed vertically penetrating a crossing portion of the lateral and longitudinal air passages; and an empty space formed around the vertical air passage at the crossing portion.

* * * * *